US005596927A

United States Patent [19]

Maurer et al.

[11] Patent Number: 5,596,927

[45] Date of Patent: Jan. 28, 1997

[54] CHAMBER DOCTOR

[75] Inventors: Dieter Maurer, Kissing; Manfred Stadlmair, Kühbach; Ernst Marny, Friedberg, all of Germany

[73] Assignee: MAN Roland Druckmaschinen AG, Offenbach am Main, Germany

[21] Appl. No.: 250,403

[22] Filed: May 27, 1994

[30] Foreign Application Priority Data

May 27, 1993 [DE] Germany ..... 9307999 U
Aug. 10, 1993 [DE] Germany ..... 43 26 810.2

[51] Int. Cl.[6] ..... B41F 31/04; B41L 27/06

[52] U.S. Cl. ..... 101/363

[58] Field of Search ..... 101/207, 208–210, 101/349, 350, 351, 352, 363, 364, 365, 366, 157, 169; 118/261, 259, 262; 15/256.51

[56] References Cited

U.S. PATENT DOCUMENTS

| | | | |
|---|---|---|---|
| 3,635,161 | 1/1972 | Leanna . | |
| 4,393,776 | 7/1983 | Toyoda | 101/368 |
| 4,432,282 | 2/1984 | Jurinak | 101/350 |
| 4,495,864 | 1/1985 | Junghans | 101/365 |
| 4,559,871 | 12/1985 | Kutzner et al. | 101/207 |
| 4,590,855 | 5/1986 | Schommer et al. . | |
| 5,058,502 | 10/1991 | Kobler | 101/366 |

FOREIGN PATENT DOCUMENTS

| | | |
|---|---|---|
| 0128411 | 12/1984 | European Pat. Off. . |
| 1486856 | 8/1970 | Germany . |
| 3114592 | 10/1982 | Germany . |
| 3303884 | 8/1984 | Germany . |
| 3612560 | 10/1987 | Germany . |
| 37044433 | 8/1988 | Germany . |
| 3843017 | 5/1990 | Germany . |
| 4001733 | 7/1991 | Germany . |
| 4004597 | 8/1991 | Germany . |
| 4140219 | 6/1993 | Germany . |

*Primary Examiner*—J. Reed Fisher
*Attorney, Agent, or Firm*—Cohen, Pontani, Lieberman, Pavane

[57] ABSTRACT

In order to achieve good lateral sealing in a simple construction of a chamber doctor, side parts are drawn toward the end sides of the work blade by magnets and/or the side parts are resiliently deformable and contact the work blade with pretensioning.

15 Claims, 3 Drawing Sheets

CHAMBER DOCTOR

BACKGROUND OF THE INVENTION

1. Field of the Invention

The invention is directed to a chamber doctor which can be used, for example, in short inking mechanisms of rotary printing presses.

2. Description of the Prior Art

DE 37 04 433 C2 shows a chamber doctor arranged at a raster roller, which chamber doctor contains a working blade and a closing blade which are arranged at a doctor holder. The chamber doctor is enclosed laterally by sealing jaws which are resiliently adjustable against the raster roller and are guided, for this purpose, in guide slots of bearing blocks which are attached to the raster roller by screws. Further, the ends of the sealing jaws press against the doctor blades. For this reason, abutments which can be adjusted by means of displaceable guide pins are arranged in the region of the doctor blades.

However, such a device is costly to manufacture, since an abutment is required for each doctor blade. Moreover, the force by which the sealing jaws bear on the doctors cannot be adjusted in a defined manner with abutments for a stationary state. Also, excessive contacting force of the sealing jaws leads to increased wear of the doctor blade in the region of the lateral seals.

SUMMARY OF THE INVENTION

The object of the present invention is to provide lateral sealing in a simple construction in which wear on the doctor blades is kept low and permanently good sealing is achieved.

Pursuant to this object, and others which will become apparent hereafter, one aspect of the present invention resides in a chamber doctor in which the side parts are drawn by magnets against the work blade and possibly also against the closing blade and/or against the cylinder to be inked with a force which can be set by the dimensioning of the magnets and which is also permanently retained in stationary operation. The force can be adjusted so that the work blade and the closing blade can move freely between the side parts. Accordingly, there is no jamming of the doctor blade that would result in increased wear on the doctor blade. The side parts have good contact with the doctor blades and with the end side of the chamber doctor body particularly when constructed in a resilient manner. Good lateral sealing is achieved in this way. Also, a precise cutting down of the doctors is not required. Because of the good contact of the side parts at the work blade the chamber doctor does not tend to form ink rings in the region of the lateral seals. Moreover, the lateral seal is very narrow so that a wider printing area can be utilized The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
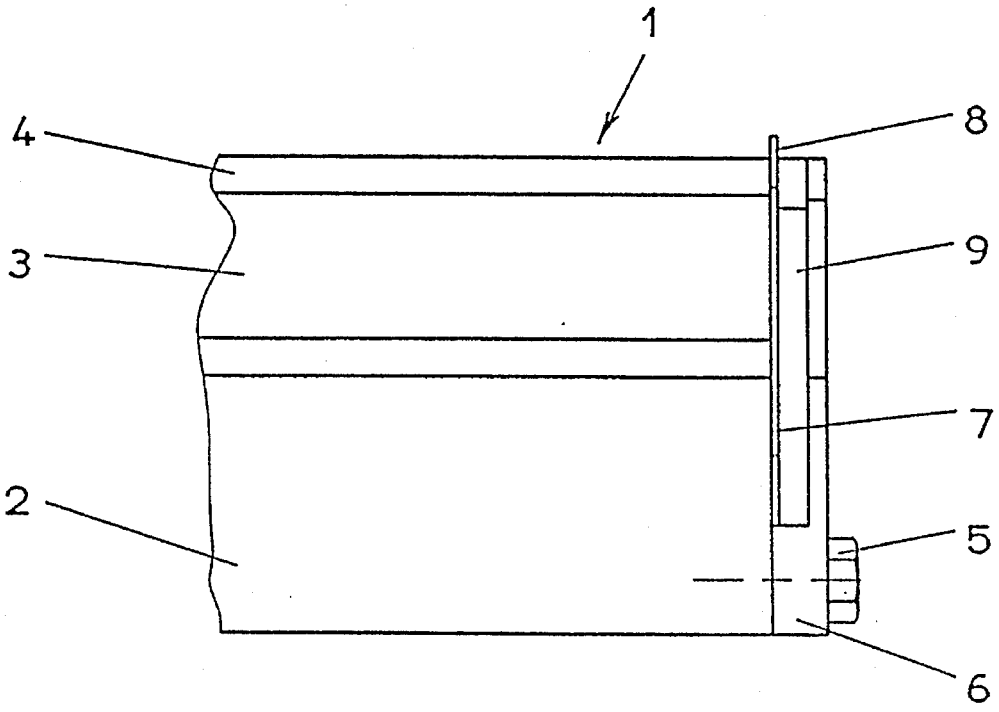
FIG. 1 shows a portion of a chamber doctor pursuant to the present invention in a plan view.
Figure 2:
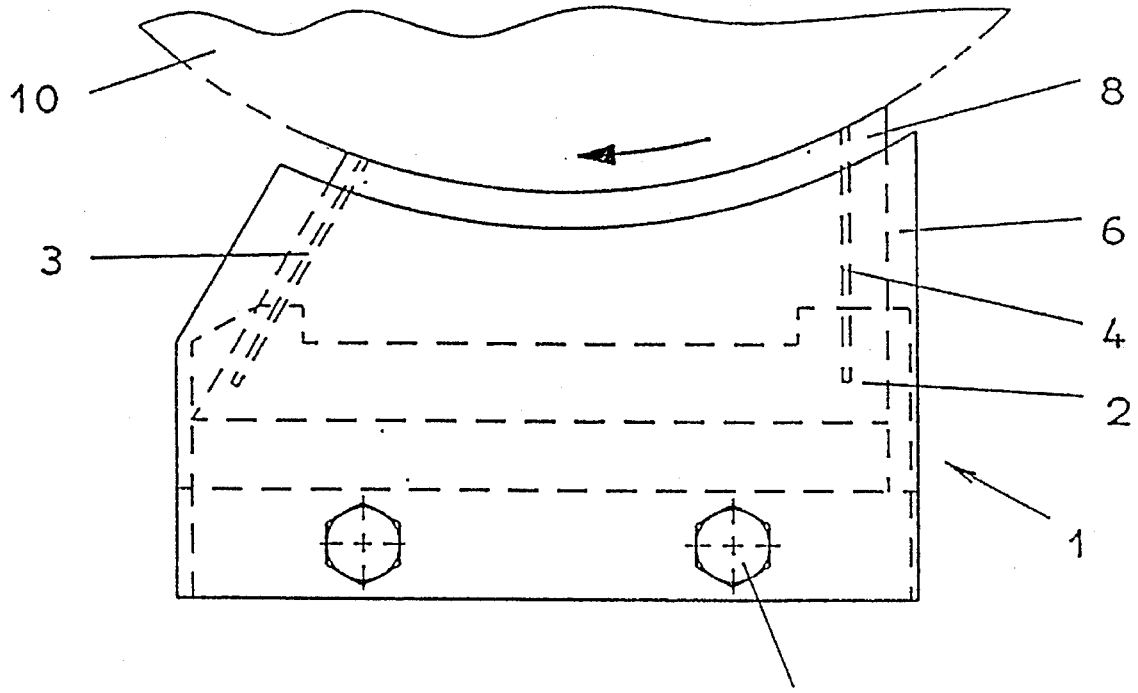
FIG. 2 is a side view of the chamber doctor of FIG. 1.
Figure 3:
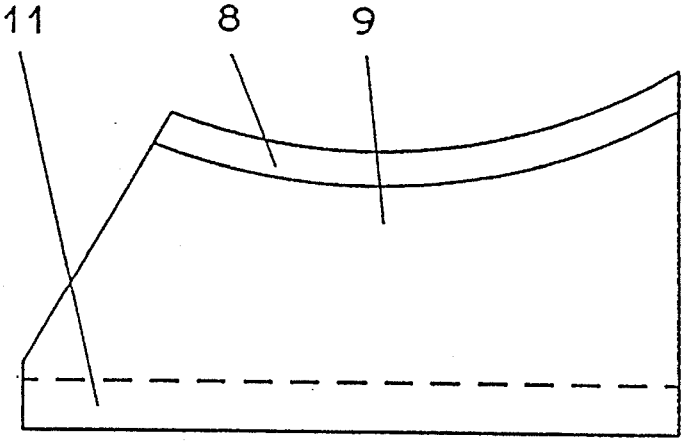
FIG. 3 is a side part of the chamber doctor with a resilient body.
Figure 4:
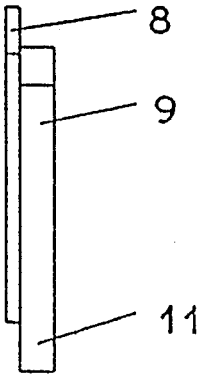
FIG. 4 is a side view of FIG. 3.

The chamber doctor 1 shown in FIG. 1 contains a chamber doctor body 2 to which a work blade 3 and a closing blade 4 are fastened. A holder 6 is attached to the two end sides of the doctor body 2 (only the end on the right side is shown) by means of screws 5. The holder 6 is shaped so that it forms a gap 7 with the end side of the chamber doctor body 2. A side part 8 is inserted into this gap 7. The side part 8 is glued to a resilient body 9 which can be made of resilient plastic, e.g. polyurethane foam, or an oil-resistant foam rubber. The side part 8 is constructed so as to be resilient in a springing manner and is produced, for example, from spring steel with a thickness of 0.2 to 1 min. Together, the side part 8 and resilient body 9 are thicker than the width of the gap 7. Accordingly, the side part 8 resiliently contacts the work blade 3 and the closing blade 4 accompanied by pretensioning of the resilient body 9. The side part 8 can easily compensate for longitudinal tolerances of the doctor blades with an order of magnitude of up to 1 mm so that a precise cutting down or fitting of the doctor blade is unnecessary. Even with a less resilient construction of the side parts good contact at the doctor blades is provided. In this case, the lengths of the doctor blades should be adapted to one another more exactly. The thickness of the resilient bodies 9 and accordingly the contact pressure force on the doctor blades is dimensioned so that the doctor blades can easily bend between the side parts 8. Each resilient body 9 is so disposed on its respective side part 8 that a region 11 thereof projects out on the side of the side part remote of a raster roller 10 (FIGS. 3, 4). The side part 8 is supported by this region 11 in the base of the holder 6 and all appropriate overdimensioning of the region 11 causes the side part 8 to be pressed resiliently against the raster roller 10. Thus, the resilient body 9 advantageously takes over the springing contact pressure of the side portion 8 against the doctor blades 3, 4 and the raster roller 10.

Figure 5:
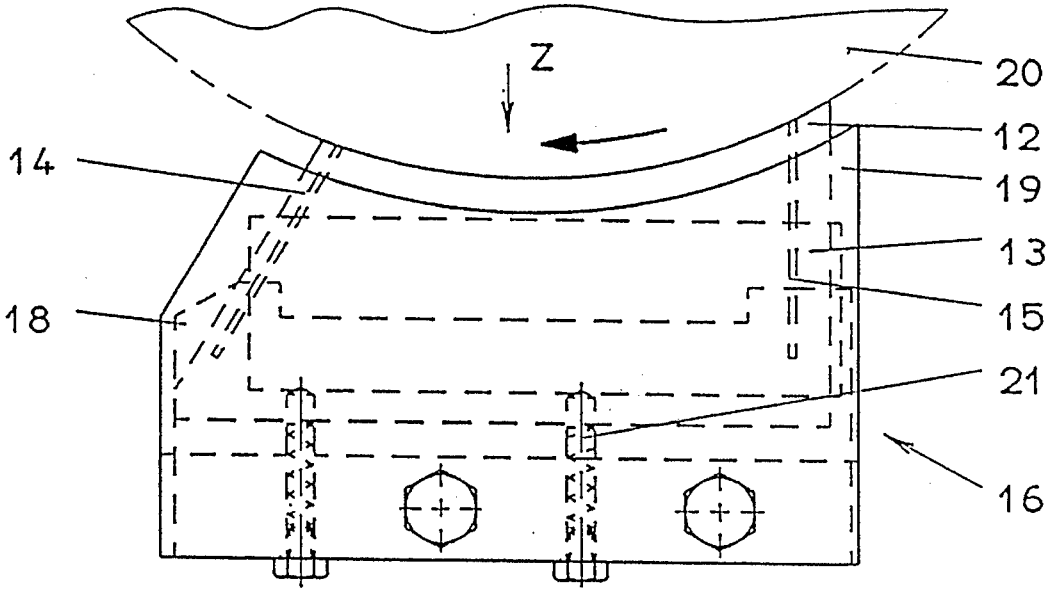
FIG. 5 is a side view of a second embodiment of the chamber doctor.
Figure 6:
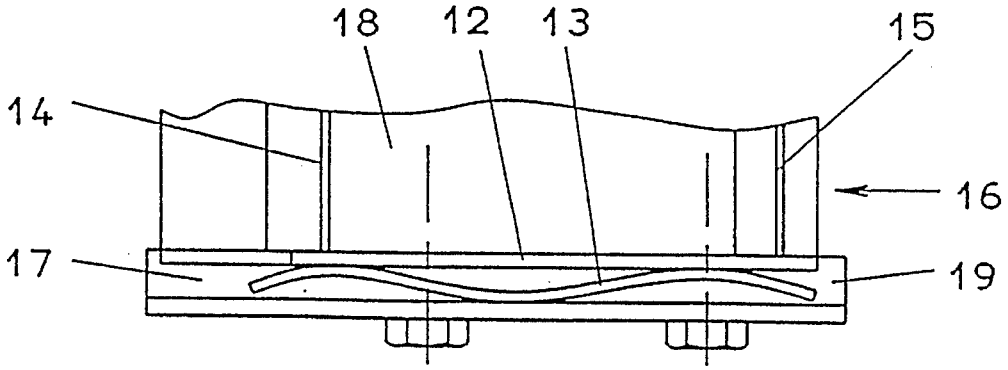
FIG. 6 is a view along arrow Z in FIG. 5.

Other springs can also be used to press the resilient side part against the doctor blades. According to another embodiment of the invention (FIGS. 5, 6), a side part 12 contacts the work blade 14 and closing blade 15 of a chamber-doctor 16 via a leaf spring 13. The side part 12 and the leaf spring 13 are inserted into a gap 17 formed by a holder 19 together with the chamber doctor body 18, the end of the holder 19 being screwed to the chamber doctor body 18. The resilient contact pressure of the side part 12 against the raster roller 20 is taken over by two pressure springs 21 guided in bore holes in the holder 19.

Figure 7:
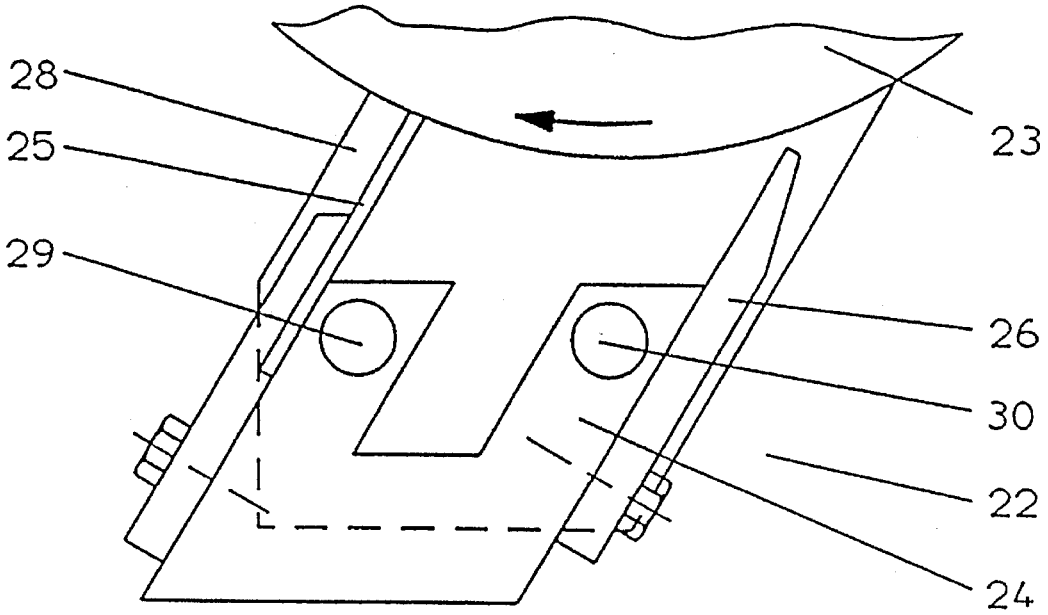
FIG. 7 is a cross-section of a third embodiment of the chamber doctor along the line I—I in FIG. 8.
Figure 8:
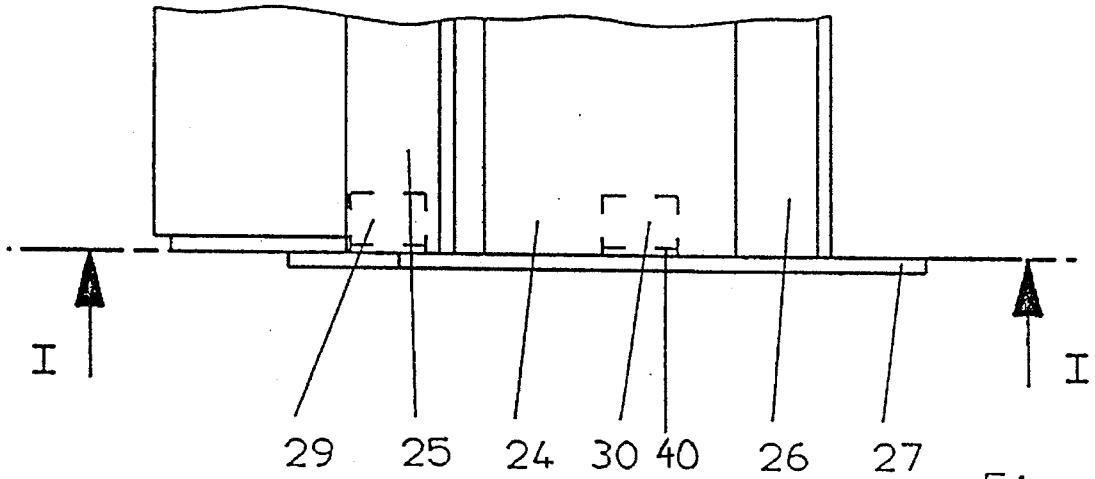
FIG. 8 is a top view of the chamber doctor of FIG. 7.

In the previous embodiments, the chamber doctor is enclosed by a closing blade. The invention also extends to equivalents such as closing strips which are arranged at a slight distance from the raster roller, e.g. 0.3 to 0.5 min. FIGS. 7 and 8 show a chamber doctor 22 of this type arranged at a raster roller 23. A work blade 25 and closing strip 26 are arranged at the chamber doctor body 24. The chamber doctor 22 is enclosed laterally by side parts 27, 28. Two magnets 29, 30 are embedded in the ends of the chamber doctor body 24. These magnets 29, 30 draw the side parts 27, 28 against the end sides of the work blade 25, the closing strip 26 and the chamber doctor body 24 so that an air gap 40 exists between the magnets and the side. The attractive force of thee magnets 29, 30 is dimensioned so that the side parts 27, 28 have good contact with the end sides, but the work blade 25 can easily bend outward. As in the preceding embodiment examples, the side parts can advantageously be constructed so as to be resilient, but the invention can also be used with a rigid construction of the side parts. The adjustment of the side parts 27, 28 toward the raster roller 23 is likewise effected by magnetic force. For this purpose, the side parts 27, 28 are magnetized in appropriate polarity and are attracted toward the raster roller 23 which is made of iron, for example. The number of magnets in the end sides of the chamber doctor body 24 can also vary. When suitably magnetized, the side parts may also be attracted toward the end sides of the work blade, the closing strip and the chamber doctor body without magnets 29, 30. In this case, the bearing force against the doctor roller can be exerted by a mechanical spring or by magnets which are fastened to the side parts in the vicinity of the raster roller. Within the scope of the invention, the side parts can also be pressed against the raster roller by magnetic force and against the end sides of the chamber doctor by means of mechanical springs.

Chamber doctors have been described in the above in connection with raster rollers, e.g. of short inking mechanisms or flexoprinting mechanisms. The invention can also be used for inking other cylinders, e.g. rotogravure form cylinders.

The invention is not limited by the embodiments described above which are presented as examples only but can be modified in various ways within the scope of protection defined by the appended patent claims.

We claim:

1. A chamber doctor, comprising: a body; a work blade fastened to the body and having lateral end sides; side members on each end side of said chamber doctor body arranged so as to laterally enclose the chamber doctor body; and magnet means for drawing the side members toward the lateral end sides of the work blade so that the side members are resiliently held against the lateral end sides of the work blade.

2. A chamber doctor according to claim 1, and further comprising a separate holder connected to each end of the chamber doctor body so as to form a gap between the respective holder and the end of the chamber doctor body to which the holder is attached, each side member being respectively arranged in one of the gaps, the chamber doctor still further comprising a plurality of leaf springs, one of said leaf springs being arranged in each of the gaps.

3. A chamber doctor according to claim 1, wherein the magnet means includes at least one magnet arranged at each end side of the chamber doctor body.

4. A chamber doctor according to claim 1, wherein the side members are made of spring steel with a thickness of 0.2 to 1 mm so as to be resilient.

5. A chamber doctor according to claim 1, wherein the side members are magnetic.

6. A chamber doctor according to claim 1, wherein the side members are made of spring steel with a thickness of 0.2 to 1 mm so as to be resilient.

7. A chamber doctor according to claim 1, wherein the side members are magnetic.

8. A chamber doctor according to claim 1, wherein the magnet means is recessed in the body so that the side members are spaced from the magnet means when the side member engage the lateral end sides of the work blade.

9. A chamber doctor, comprising: a body; a work blade fastened to the body and having lateral ends; side members on each end of said chamber doctor body arranged so as to laterally enclose the chamber doctor body; and magnet means for mounting the side members to the body so that the side members are resiliently deformable and contact the lateral ends of the work blade under pretension.

10. A chamber doctor according to claim 9, and further comprising holders respectively connected to each side member of the chamber doctor body so as to form gaps between the holders and each side member of the body, each side member being respectively arranged in one of the gaps.

11. A chamber doctor according to claim 10, and further comprising a resilient body arranged in each gap.

12. A chamber doctor according to claim 11, further including a raster roller wherein the resilient body is attached to a respective side member so as to have a portion that projects from a side of the respective side member remote from said raster roller, each side member being supported under pretension in the holder by the projecting portion of the resilient body.

13. A chamber doctor according to claim 9, wherein the magnet means includes at least one magnet arranged at each end side of the chamber doctor body.

14. A chamber doctor according to claim 9, wherein the side members are made of spring steel with a thickness of 0.2 to 1 mm so as to be resilient.

15. A chamber doctor according to claim 9, wherein the side members are magnetic.

* * * * *